US008205304B2

(12) United States Patent
Le

(10) Patent No.: US 8,205,304 B2
(45) Date of Patent: Jun. 26, 2012

(54) ADJUSTABLE FRICTION HINGE

(76) Inventor: Tam Le, Santa Ana, CA (US)

( * ) Notice: Subject to any disclaimer, the term of this patent is extended or adjusted under 35 U.S.C. 154(b) by 187 days.

(21) Appl. No.: 12/790,631

(22) Filed: May 28, 2010

(65) Prior Publication Data

US 2011/0289727 A1 Dec. 1, 2011

(51) Int. Cl.
*E05D 11/08* (2006.01)

(52) U.S. Cl. ..... 16/342; 16/340

(58) Field of Classification Search ..... 16/342, 16/337, 338, 339, 330, 340; 403/141, 142, 403/143, 160, 164
See application file for complete search history.

(56) References Cited

U.S. PATENT DOCUMENTS

| | | | | | |
|---|---|---|---|---|---|
| 540,764 | A * | 6/1895 | Spring | 403/150 |
| 1,619,107 | A * | 3/1927 | Enright | 16/340 |
| 1,768,810 | A * | 7/1930 | Walton | 16/340 |
| 1,847,937 | A * | 3/1932 | Fetters | 16/339 |
| 1,956,040 | A * | 4/1934 | Meyer | 16/340 |
| 2,342,477 | A | 2/1944 | Magnenat | |
| 3,474,470 | A * | 10/1969 | Watson | 4/240 |
| 4,490,884 | A | 1/1985 | Vickers | |
| D284,931 | S | 8/1986 | Bisbing | |
| 4,630,332 | A | 12/1986 | Bisbing | |
| 4,630,333 | A | 12/1986 | Vickers | |
| D344,467 | S | 2/1994 | Hung et al. | |
| 7,506,407 | B2 * | 3/2009 | Ishiwata | 16/340 |

* cited by examiner

*Primary Examiner* — Chuck Y. Mah

(57) ABSTRACT

An adjustable friction hinge with a first hinge portion with two spaced apart first hinge knuckles and second hinge portion having a second hinge knuckle with rotatably fit together. A barrel bushing is non-rotatably positioned in the second hinge knuckle. A friction bushing is slidably and non-rotatably located in openings in the two first hinge knuckles. A threaded compression nut, and a non-threaded compression nut are located in the two spaced apart first hinge knuckles. A screw passes through the non-threaded compression nut, the spaced apart first hinge knuckles, the second hinge knuckle, the two friction bushings, and into the threaded compression nut. When the screw is tightened, the threaded and non-threaded compression nuts force the two frictional bushing into frictional contact with the barrel bushing to increase a force required to move the first hinge portion and the second hinge portion relative to each other.

10 Claims, 10 Drawing Sheets

ADJUSTABLE FRICTION HINGE

BACKGROUND OF INVENTION

The invention relates to an adjustable friction hinge for use with lids, covers, doors and the like, and in particular to a hinge which has a high degree of adjustability and degree of the force required to pivot its pivotally connected parts.

SUMMARY OF THE INVENTION

Adjustable friction hinges are known in the art. For example, some friction hinges use a tightenable axial screw in place of where a hinge pin normally would be positioned, an example of which is shown in prior art FIG. 1. The tightenable axial screw has a head which seats at one end of a hinge knuckle and a threaded end which tightens into threaded hole in another hinge knuckle at the other end of first pivoting portion of the hinge. The screw passes through at least one intermediate knuckle which is part of a second pivoting portion of the hinge. Flash washers of different material than the first and second pivoting portions are positioned between contact surfaces of the knuckles in order to provide for better control of movement and to decrease squeaking. By tightening the axial screw, the two ends knuckles of the first pivoting portion of the hinge will compress against the intermediate knuckle which is part of a second pivoting portion of the hinge, and thereby increase the frictional force required to move the first pivoting portion and second pivoting portion of the hinge relative to each other.

Another style of prior art friction hinge is shown in FIG. 2. This prior art friction hinge design has a first hinge portion with two spaced apart knuckles with end leafs, with an immovable bar passing therebetween. A second hinge portion comprises an intermediate knuckle that located between the two spaced apart knuckles and comprising a strap that loops around the immovable bar and has a screw that screws downwardly into an intermediate leaf portion. By tightening the screw, the strap will tighten on the immovable bar, thereby increasing the friction between the strap and the immovable bar, and thus increases the force required to move the required to move the first hinge portion and second hinge portion relative to each other.

However, both designs have deficiencies. For example, in the axial screw design, the two ends knuckles of the first hinge portion must be compressed together move closer to each other to compress onto the intermediate knuckle of the second hinge portion. Together with the washers being flat, a considerable amount of tightening force of the screw is required to generate sufficient friction between the first and second hinge portions.

In the prior art tightenable strap design, although sufficient frictional force can be generated, the appearance of the hinge is compromised by the requirement of the strap tightening screw and bulky base There accordingly remains a need for an improved friction hinge that has an attractive appearance and which can generate a wide range of consistently retained frictional force to retain the hinge leafs in position.

DETAILED DESCRIPTION

Figure 1A:
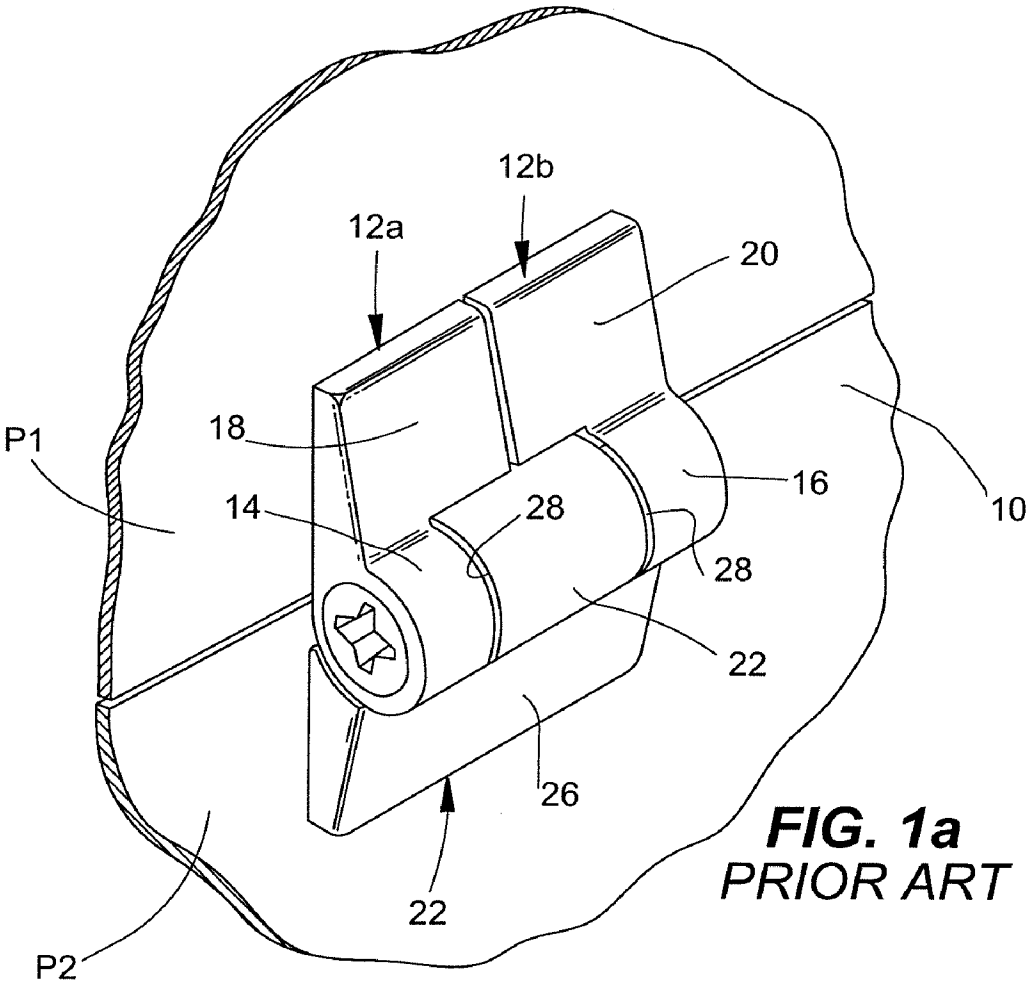
FIG. 1a PRIOR ART
FIG. 1*a* is a perspective view of a prior art tightenable axial screw friction hinge.
Figure 1B:
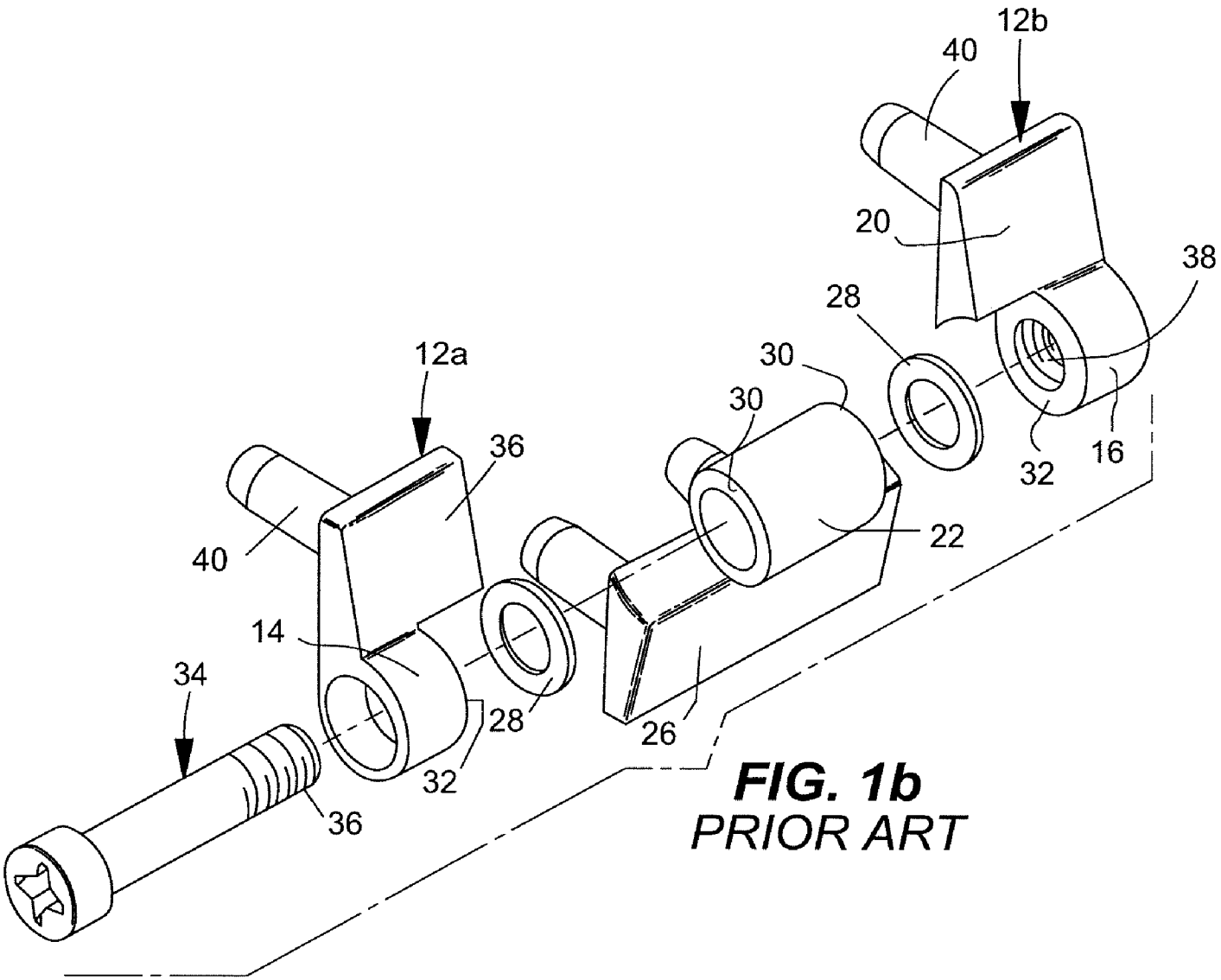
FIG. 1b PRIOR ART
FIG. 1*b* is an exploded view of the prior art tightenable axial screw friction hinge of FIG. 1*a*.

FIG. 1 is a perspective view of a prior art tightenable axial screw friction hinge 10, and FIG. 1*b* is an exploded view of same. It has a first hinge portion 12*a* and 12*b* with straddling knuckles 14 and 16 connected to leafs 18 and 20, respectively. The leafs 18 and 20 will be attached to a first object P1 to be hinged by the tightenable axial screw friction hinge 10, such as a door frame. A second hinge portion 22 has an intermediate knuckle 24 that is attached to a leaf 26. The leaf 26 is attached to a second object P2 to be hinged together, such as a door. The intermediate knuckle 24 is positioned between the straddling knuckles 14 and 16. In the version shown, the first hinge portion 12*a* and 12*b* have leafs 18 and 20 that are shown as being split, but they can be joined together. Flat friction washers 28 are placed between two flat side ends 30 of the intermediate knuckle 24 and the flat inside ends 32 of straddling knuckles 14 and 16. A screw 34 with a threaded end 36 threads into a threaded aperture 38 in straddle knuckle 16 and is used to tighten the straddling knuckles 14 and 16 and friction washers 26 against the two flat side ends 30 of the intermediate knuckle 24 and against the flat inside ends 30 of the straddling knuckles 14 and 16 to thereby tightly sandwich the intermediate knuckle 24 between the two straddling knuckles 14 and 16. By tightening or loosing the screw 34, the force required to pivot the first hinge portion 12 and the second hinge portion 22 relative to each other can be adjusted. However, in order to force the flat friction washers 28 against the two side ends 30 of the intermediate knuckle 24, the straddling knuckles 14 and 16 connected to leafs 18 and 20 must be displaced inwardly toward each other. This can require a lot of force, particularly as the leafs 18 and 20 will be secured to the first object P1 to be hinged together with retention means, such as pins 40. The second hinge portion 22 also has an attachment pin 42 on its leaf 26. Moreover, since the area of contact between the flat friction washers 28 and the flat inside ends 32 of the straddling knuckles 14 and 16 and the flat side ends 30 of the intermediate knuckle 24 is limited, considerable force must be used to tighten the screw 34.

Figure 2:
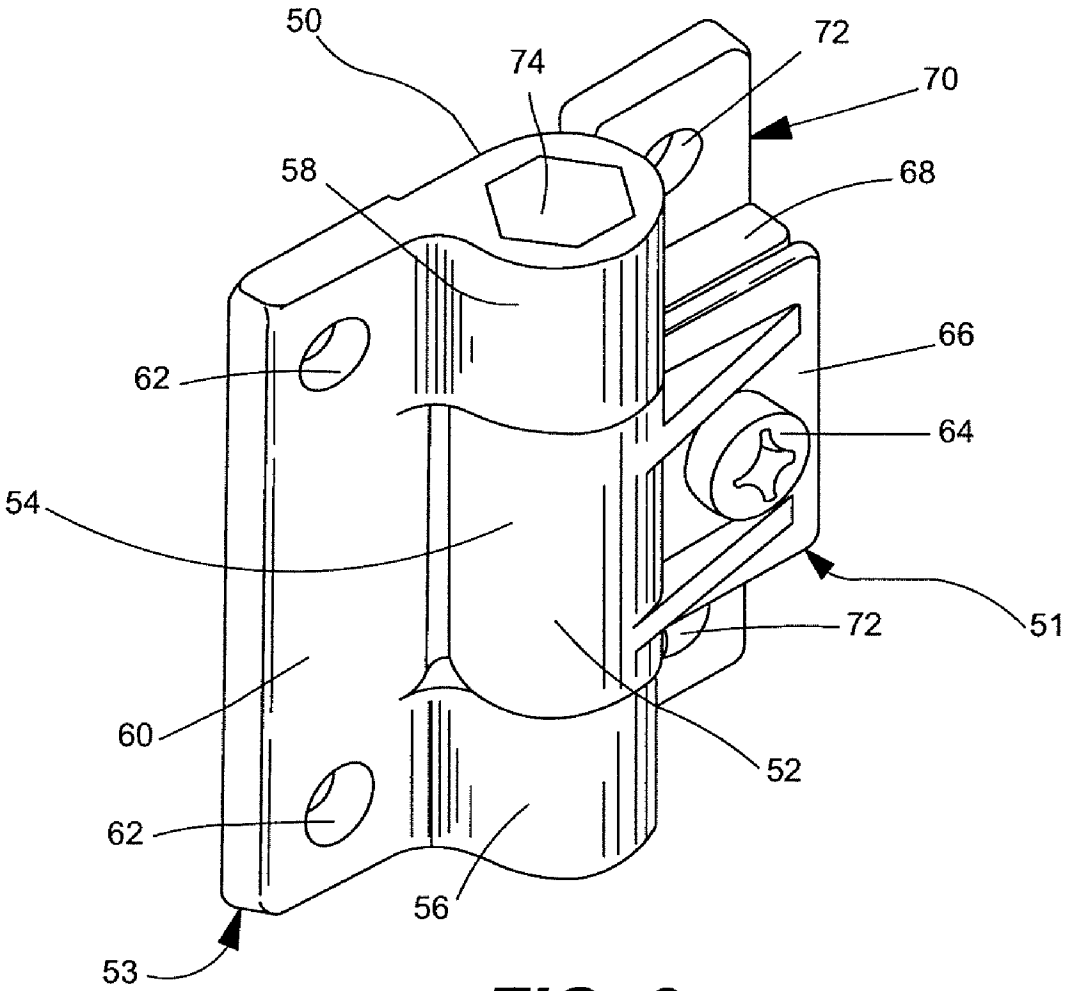
FIG. 2 PRIOR ART
FIG. 2 is a perspective view of a prior art tightenable strap screw friction hinge.

FIG. 2 is a perspective view of a prior art tightenable strap screw friction hinge 50. It has first hinge portion 51 which has an intermediate knuckle 52 that comprises a wraparound portion 54 that is positioned between two straddling knuckles 56 and 58 that are connected to a leaf 60 of a second hinge portion 53 Attachment holes 62 can be formed in leaf 60. An adjustment screw 64 passes through an end 66 of the strap 54. The adjustment screw 64 screws into a leaf platform 68 on leaf 70. Attachment holes 72 can be formed in leaf 70. A bar 74 bridges the two straddling knuckles 56 and 58 and passes through the strap 54. By tightening the adjustment screw 64, the strap 54 will tighten around the bar 74 and thereby increase the force required to pivot the first hinge portion 51 and the second hinge portion 53 relative to each other.

Figure 3:
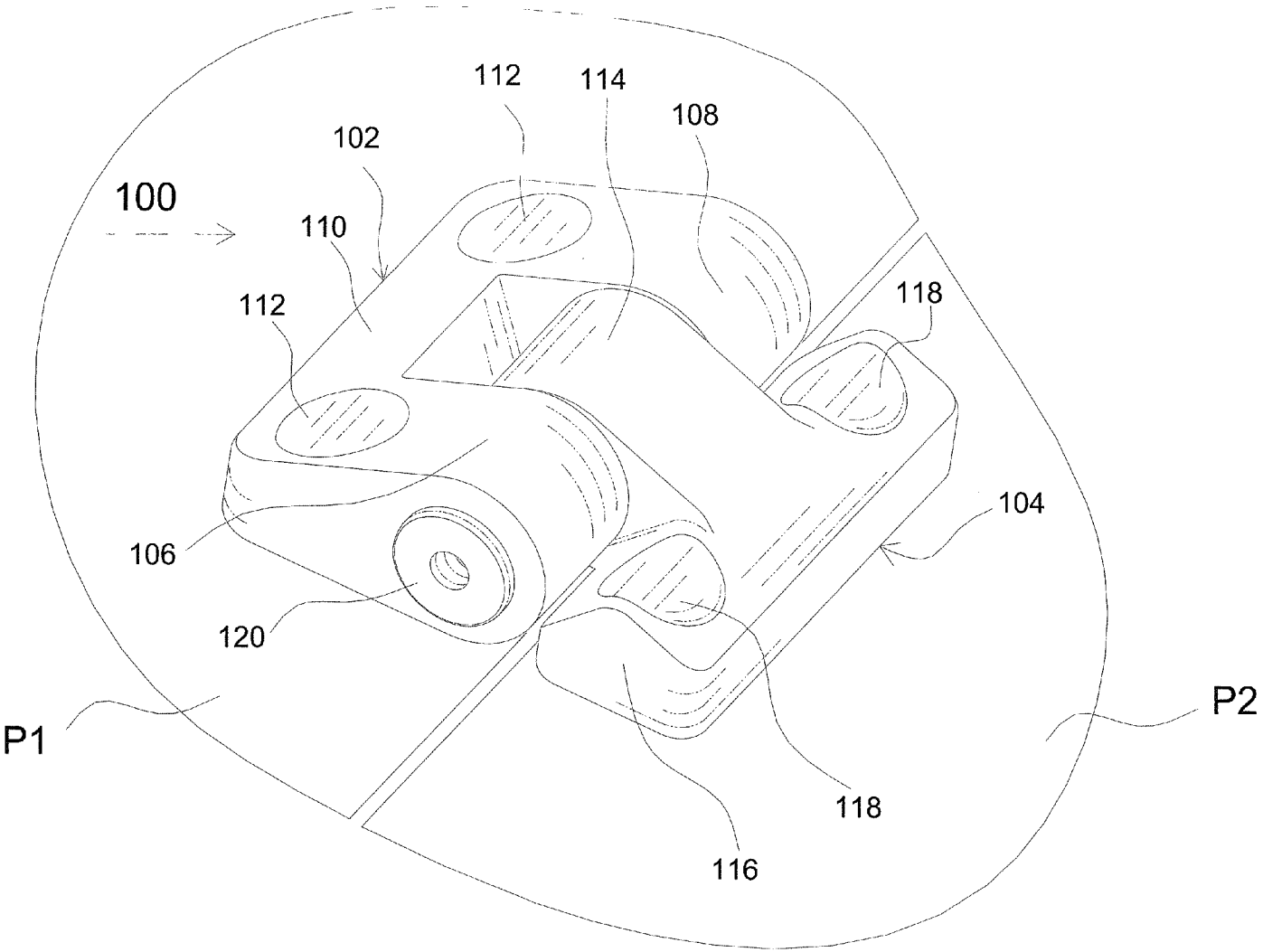
FIG. 3 is a top perspective view of an exemplary embodiment of the adjustable friction hinge of the invention.
Figure 5:
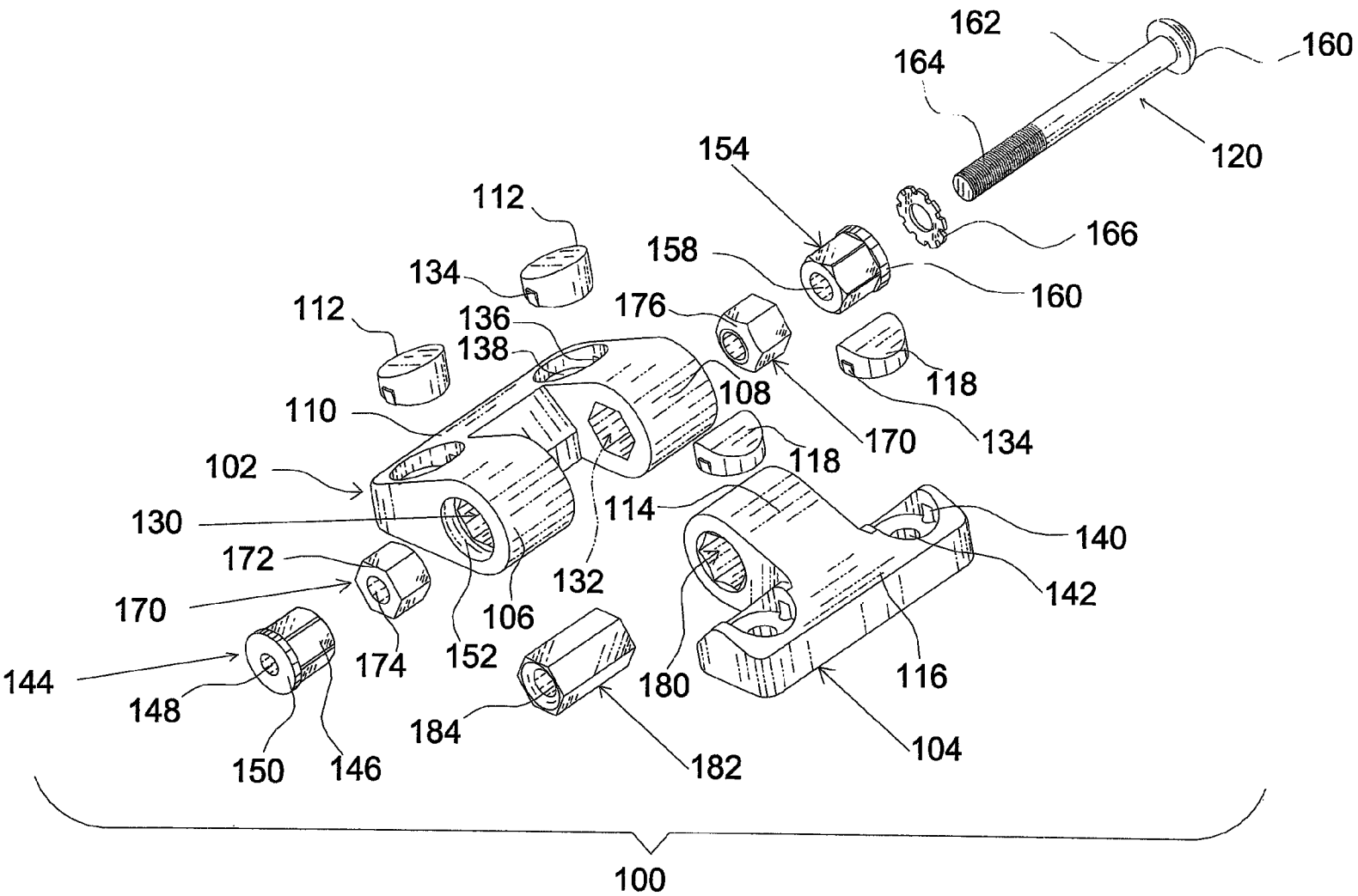
FIG. 5 is an exploded top perspective view showing the components of the exemplary adjustable friction hinge of FIG. 3.

Turning now to FIG. 3, there is a shown a top perspective view of an exemplary embodiment of the adjustable friction hinge 100 of the invention and FIG. 5 is an exploded top perspective view thereof. It has a first hinge portion 102 and a second hinge portion 104, which are attached to a first object P1 and second object P2, respectively, to be hinged together. The first hinge portion 102 has two spaced apart knuckles 106 and 108 connected to a leaf 110. Screw hole covers 112 are shown in place on the leaf 110. The second hinge portion 104 has an intermediate knuckle 114 that extends from a leaf 116. Screw hole covers 118 are shown in place on the leaf 116. An axial screw 120 connects the first hinge portion 102 and the second hinge portion 104 and adjusts the force required to pivot the first hinge portion 102 and the second hinge portion 104 relative to each other, as will be described further below. The screw 120 is preferably formed of metal and will maintain its length under tension with little stretching.

Figure 4:
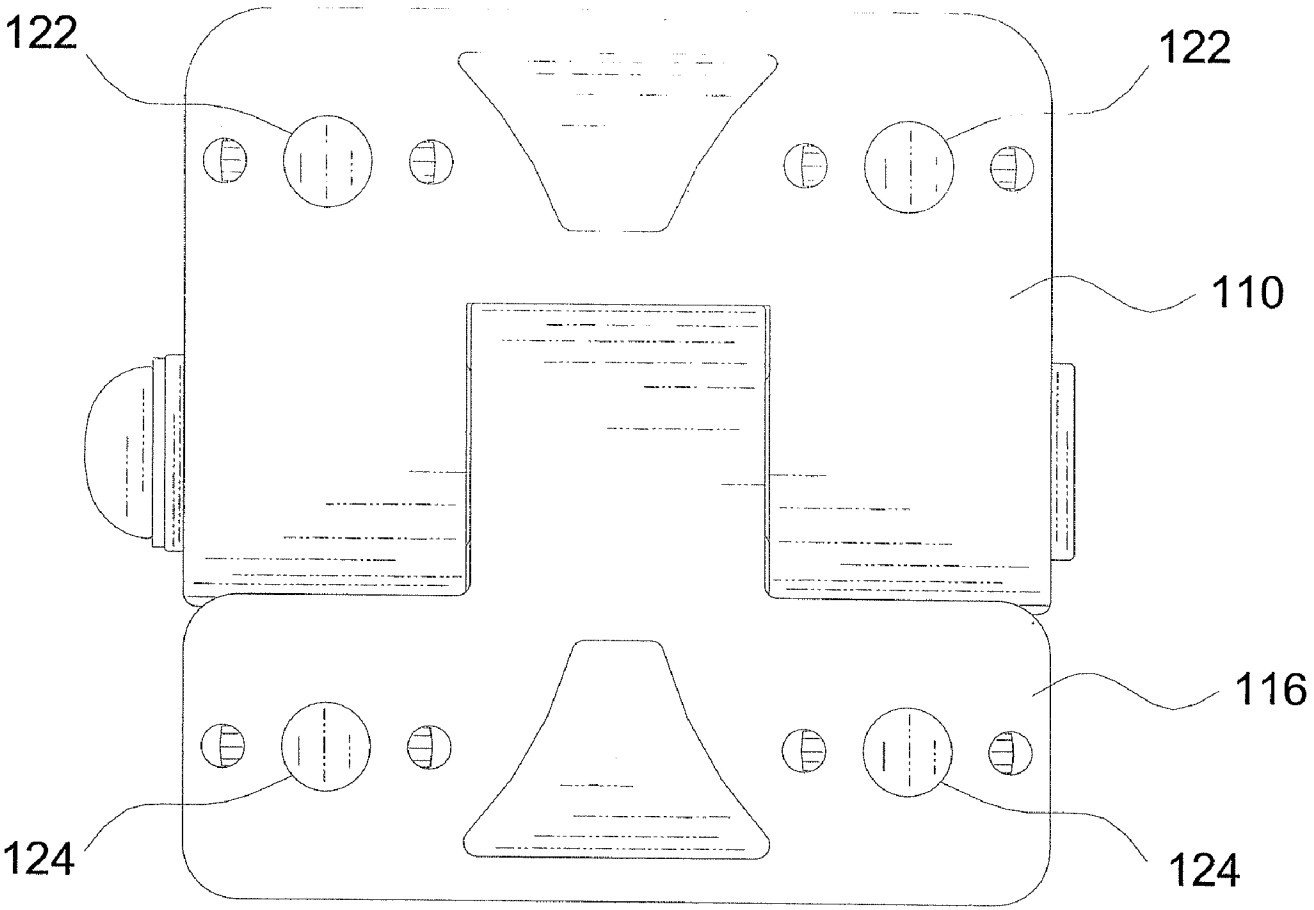
FIG. 4 is a bottom plan view of the exemplary adjustable friction hinge of FIG. 3.

FIG. 4 is a bottom plan view of the exemplary adjustable friction hinge 100 of FIG. 3. Attachment holes 122 are formed in the leaf 110, and attachment holes 124 are formed in leaf 116 through which screws or bolts can be used to attached the adjustable friction hinge 100 to a door and frame, etc.

Figure 7:
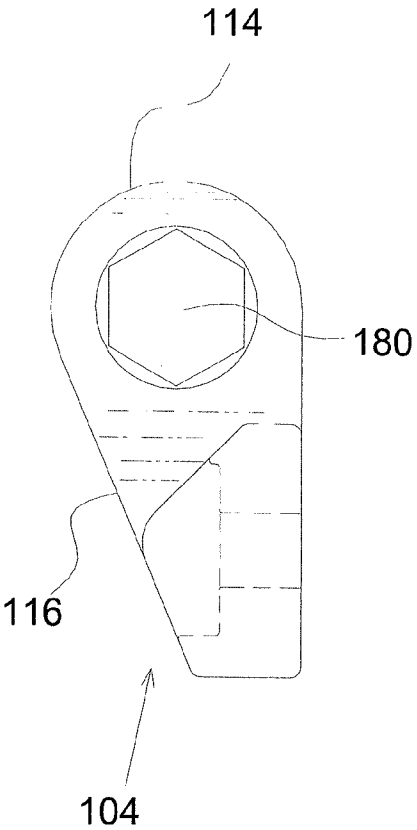
FIG. 7 is a side view of the rotating leaf base component of FIG. 6.
Figure 6:
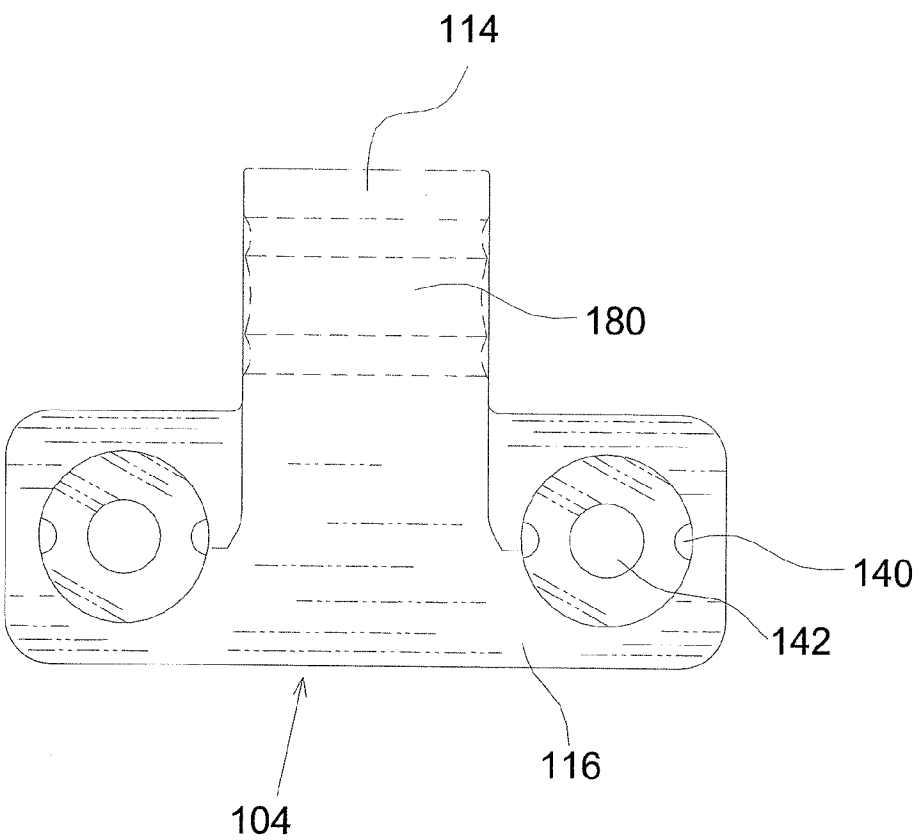
FIG. 6 is a top plan view of the rotating leaf base component of the exemplary adjustable friction hinge of FIG. 5.
Figure 9:
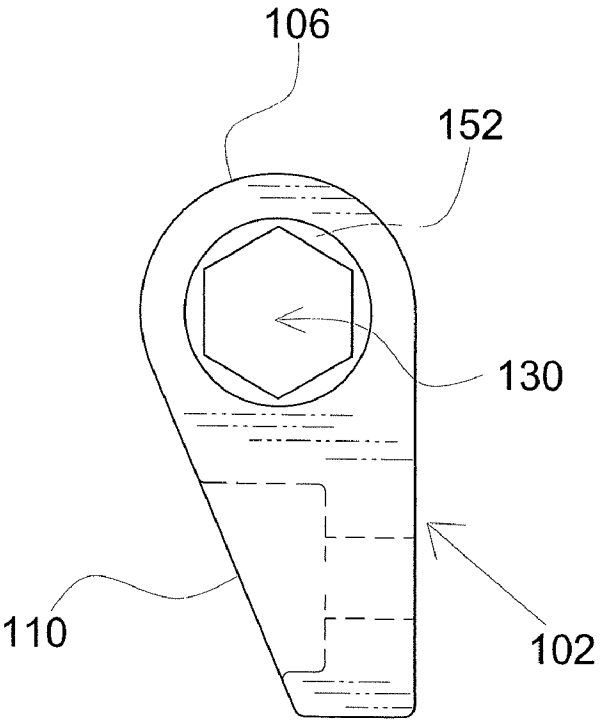
FIG. 9 is a side view of the stationary leaf base component of FIG. 8.
Figure 8:
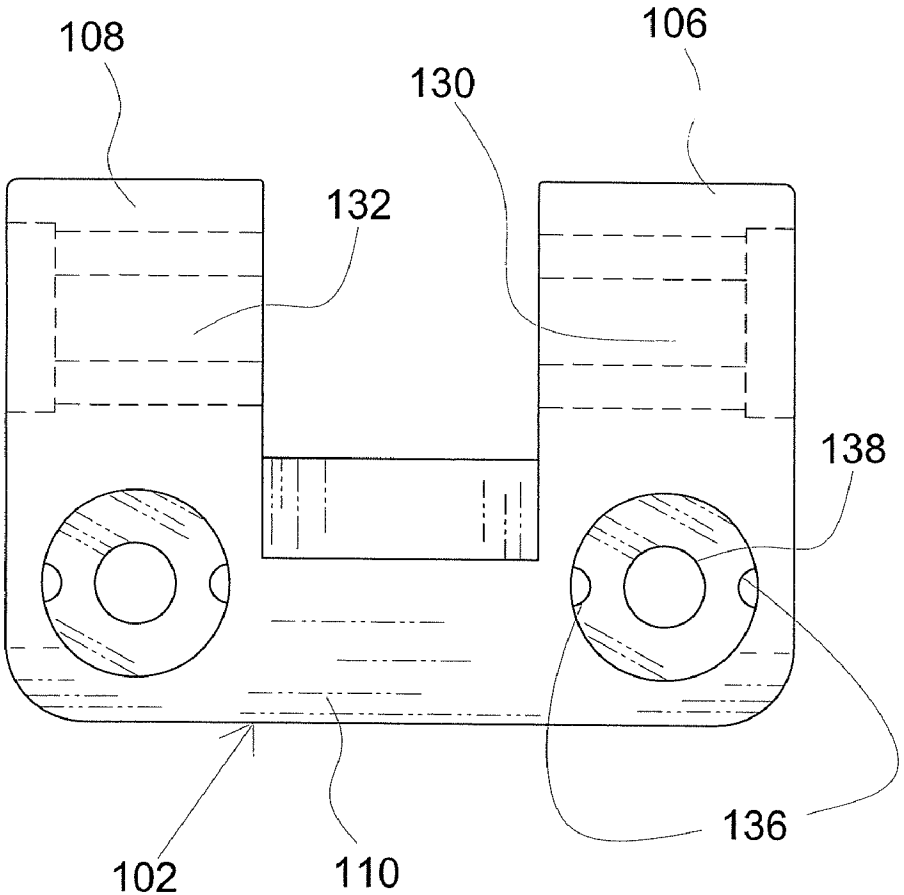
FIG. 8 is a top plan view of the stationary leaf base component of the exemplary adjustable friction hinge of FIG. 5.

FIG. 5 is an exploded top perspective view showing the components of the exemplary adjustable friction hinge 100 of FIG. 3. It has a first hinge portion (also sometimes referred to as the rotating leaf base component) 102 and a second hinge portion (also sometimes referred to as the stationary leaf base component) 104, which are attached to a first object (not shown) and a second object (not shown) to be hinged together. The first hinge portion 102 has two spaced apart knuckles 106 and 108 connected to a leaf 110. Screw hole covers 112 are shown in place on the leaf 110. The second hinge portion 104 has an intermediate knuckle 114 that extends from a leaf 116. FIG. 6 is a top plan view and FIG. 7 is a side view of the of the first hinge component 102. Screw hole covers 118 are shown in place on the leaf 116. An axial screw 120 connects the first hinge portion 102 and the second hinge portion 104 and adjusts the force required to pivot the first hinge portion 102 and the second hinge portion 104 relative to each other, as will be described further below. Formed in the knuckles 106 and 108 of the first hinge portion 102 are non-round axial through apertures 130 and 132, respectively. In the figures, they are shown as having hexagonal cross-sections, but they can have other cross-sections, such as square, star-shaped, etc., so as to prevent components inserted into close contact with the apertures 130 and 132 from rotating. The screw hole covers 112 can have protrusions 134 which snap into retention openings 136 in the perimeter of screw holes 138 in the leaf 110. Likewise, screw hole covers 118 can have protrusions 134 which snap into retention openings 140 in the perimeter of screw holes 142 in the leaf 104. The screw hole covers 112 and 118 are preferably contoured to match the contours of the first hinge portion 102 and the second hinge portion 104 and can give the hinge of the invention a more streamlined appearance.

Figure 11:
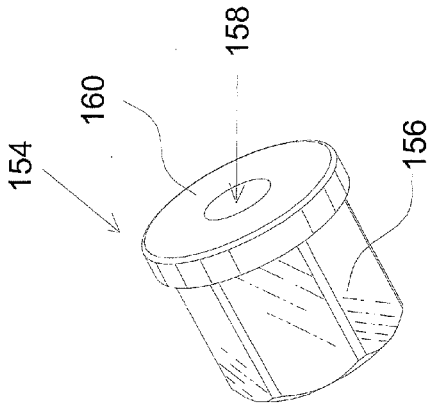
FIG. 11 is a front perspective view of an unthreaded bushing nut component of the exemplary adjustable friction hinge of FIG. 5.
Figure 10:
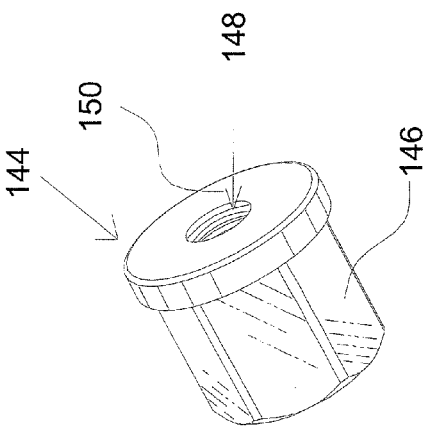
FIG. 10 is a front perspective view of a threaded compression nut component of the exemplary adjustable friction hinge of FIG. 5.

Still referring to FIG. 5, a threaded compression nut 144 is provided, which has a shank section 146 matched to slidably fit in aperture 130, without rotating therein. The threaded compression nut 144 has a threaded hole 148 and preferably has a head 150, which head 150 fits into a rim 152 at the entrance of aperture 130. The threaded compression nut 144 is also shown in FIG. 10. An unthreaded compression nut 154 is provided, which has a shank section 156 matched to slidably fit in aperture 132, without rotating therein. The unthreaded compression nut 154 has a through hole 158 and preferably has a head 160, which head 160 fits into a rim (not shown) at the entrance of aperture 132. The unthreaded compression nut 154 is also shown in FIG. 11. The threaded compression nut 144 and the unthreaded compression nut 154 will slide in their respective apertures 130 and 132, and can be made of materials different (e.g., stainless steel) than the material used to form the first hinge portion 102 and the second hinge portion 104, which for example can be made of glass fiber filled acetal. The screw 120 has a head 160 which seats against the head 160 of the unthreaded compression nut 154, has a smooth shank 162 and a threaded end 164 which screws into the threaded hole 148 in the threaded compression nut 144. The smooth shank 162 of the screw 120 passes through the through hole 158 of the unthreaded compression nut 154, and can pass through an antirotation lock washer 166. The screw 120 passes through friction bushings 170, which friction bushings 170 have a cross section (e.g., hexagonal) which is size and shaped to slidably fit but not rotate in the apertures 130 and 132 in knuckles 106 and 108, respectively.

Figure 12:
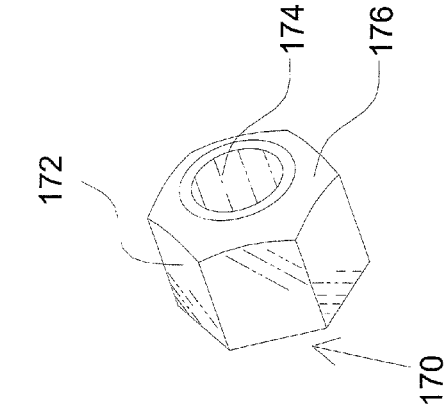
FIG. 12 a front perspective view of an beveled friction bushing component of the exemplary adjustable friction hinge of FIG. 5.

As shown in FIGS. 5 and 12, the beveled friction bushings 170 have a hexagonal cross section 172 and a through hole 174 through which the screw 120 freely passes. The beveled friction bushings 170 have a compression end 176 which is non flat, and is preferably convexly cupped or angled. The beveled friction bushings 170 are preferably made of a hard plastic materials, such as polycarbonate, nylon, etc. The second hinge portion 104 has a non-round through hole 180. FIG. 6 is a top plan view and FIG. 7 is a side view of the of the second hinge component 104. In the figures, while the non-round through hole 180 is shown as having hexagonal cross-section, it can have other cross-sections, such as square, star-shaped, etc., so as to prevent an intermediate bushing 182 inserted into the through hole 180 from rotating therein, but snuggly received. The intermediate barrel bushing 182 is preferably formed of a material different than that of the beveled friction bushings 170, such as stainless steel. The intermediate barrel bushing 182 has an axial hole 184 formed axially therethrough which is sized so that the threaded ends 164 and shank 162 of the screw 120 can pass therethrough. At each end of the intermediate barrel bushing 182 a bevel 186 is formed. It is possible that the intermediate barrel bushing 182 can be formed directly with the second hinge portion 102 rather than comprising a separate piece. This would be possible, for example, if the second hinge portion 102 is formed of the same material as the intermediate barrel bushing 182. Likewise, rather than a single barrel hinge, separate inserts with beveled ends could be inserted into both ends of the opening in the second hinge portion. For example, these could comprise metal nuts with round through holes with a concavity facing the beveled friction bushing.

Figure 14:
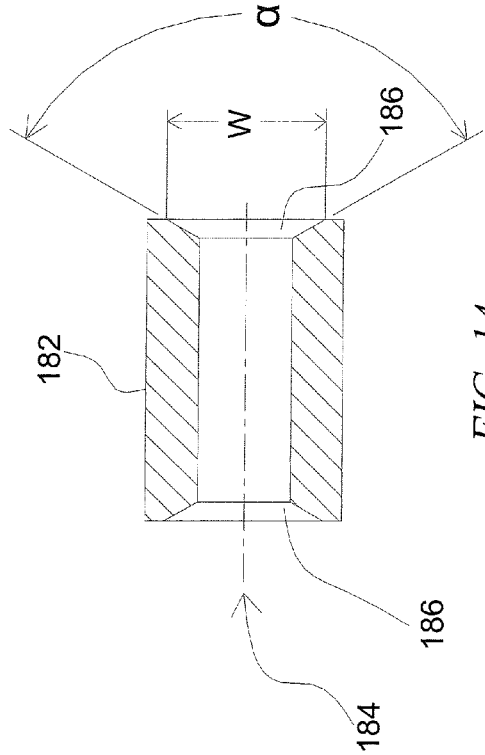
FIG. 14 is a cross sectional view through the barrel bushing component of FIG. 13.
Figure 13:
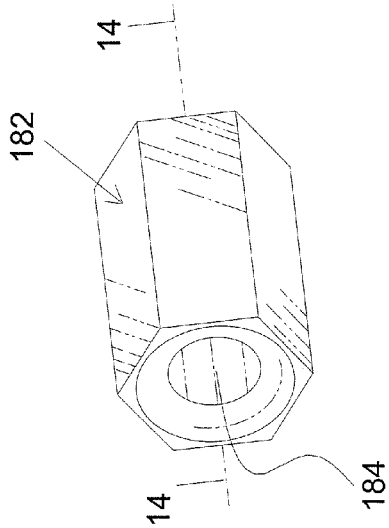
FIG. 13 a front perspective view of an barrel bushing component of the exemplary adjustable friction hinge of FIG. 5.

As best shown in FIGS. 13 and 14, the bevels 186 preferably have an angle α and width "w" that is sized to seat with the compression end 176 of the beveled friction bushing 170. The bevel 186 is shown as being flat, which would be the case when the compression end 176 of the beveled friction bushing 170 is uncurved, but simply beveled. The bevel should be curved to match the curvature of the compression end 176 of the friction bushing 170. The beveling of the friction bushing 170 and the beveling of the intermediate barrel bushing 182 results in greater contact surface and greater frictional force being generated when the two are brought into contact with each other.

Figure 15:
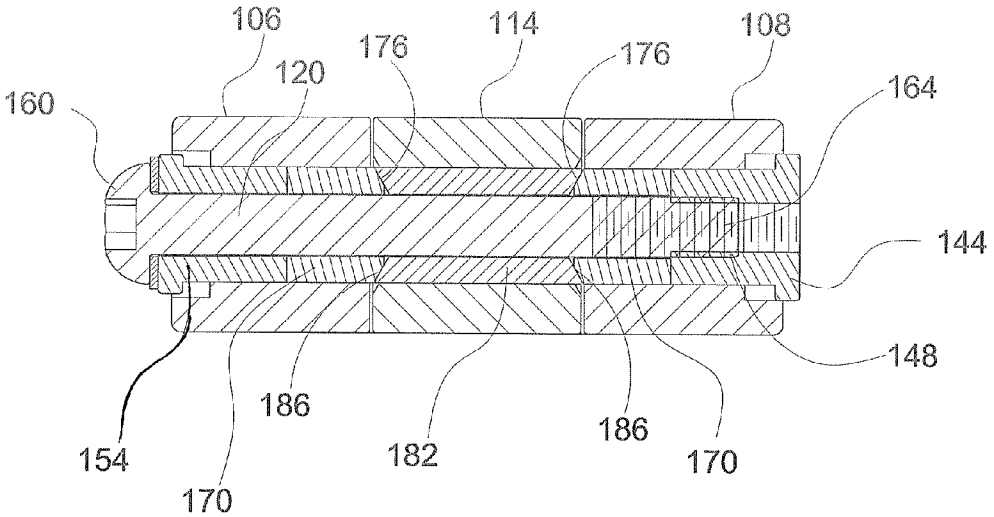
FIG. 15 is a cross-sectional view through 15-15 of FIG. 3 of the exemplary hinge of the invention.

Turning now to FIG. 15, there is shown is a cross-sectional view of the exemplary adjustable friction hinge 100 of the invention. As can be seen, the screw 120 bears with its head 160 on the unthreaded compression nut 154 and its threaded end 164 screws into the threaded hole 148 of the threaded compression nut 144. This will cause the unthreaded compression nut 154 and the threaded compression nut 144 to be moved closer together, which pushes the beveled friction bushings 170 inwardly with their compression end 176 into contact with the bevels 186 located at the two ends of the intermediate barrel bushing 182. By tightening or loosening the screw 120, users can adjust and consistently maintain the internal frictional generated between the beveled friction bushings 170 connected with the knuckles 106 and 108 of the first hinge portion 102, and the intermediate barrel bushing 182 connected with the intermediate knuckle 114 of the second hinge portion 104. This friction will determine how much force is required to move the first and second hinge portions 102 and 104 relative to each other.

Figure 16:
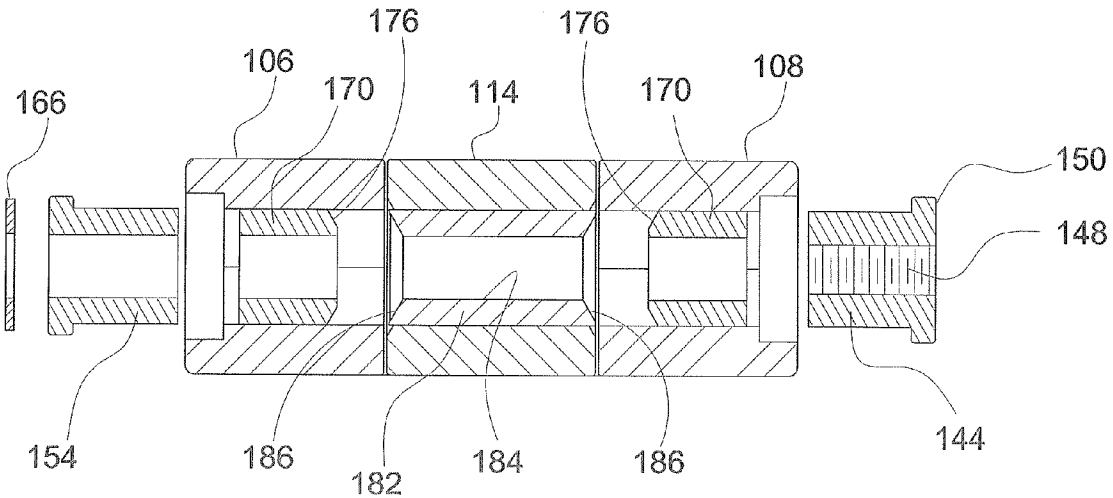
FIG. 16 is a cross-sectional view through 15-15 of FIG. 3 of the exemplary hinge, but with the screw removed and the hex bushing backed out.

FIG. 16 is a cross-sectional view of the exemplary adjustable friction hinge 100, but with the screw removed and the friction bushings 170 completely backed out of the bevels 186 in the intermediate bushing 182 and the threaded compression nut 144 and the unthreaded compression nut 154 backed out of the non-round axial through apertures 130 and 132 in knuckles 106 and 108, respectively. This is the state of the two hinge portions 102 and 104 prior to being assembled.

Although the adjustable friction hinge is shown as having a first hinge portion with two knuckles and a second hinge portion with one hinge knuckle that fits in the space between the two hinge knuckles of the first hinge portion, the first hinge portion can be dividing into two halves.

Having thus described the exemplar y embodiments of the present invention, it should be understood by those skilled in the art that the above disclosures are exemplary only and that various other alternatives, adaptations, and modifications may be made within the scope of the present invention. The presently disclosed embodiment is to be considered in all respects as illustrative and not restrictive. The scope of the invention being indicated by the appended claims rather than the foregoing description, and all changes which come within the meaning and range of equivalency of the claims are, therefore, intended to be embraced therein.

What is claimed is:

1. An adjustable friction hinge, comprising:

a first hinge portion having two spaced apart first hinge knuckles with opening formed in each first hinge knuckle;

a second hinge portion having a second hinge knuckle with an opening formed there, the second hinge knuckle rotatably fitting in a space between the two spaced apart first hinge knuckles;

two friction bushings, one each located in the openings in the first hinge knuckles and being movable to engage with the second hinge knuckle;

a screw which passes through the two spaced apart first hinge knuckles and through the second hinge knuckle to cause the two frictional bushing to move into frictional contact with the second hinge knuckle to adjust a force required to move the first hinge portion and the second hinge portion relative to each other;

a threaded compression nut inserted in the opening in one of the two spaced apart first hinge knuckles; and a non-threaded compression nut inserted in the opening in the other of the two spaced apart first hinge knuckles, wherein the threaded compression nut and the non-threaded compression nut will, upon the screw being tightened, move the threaded compression nut and the non-threaded compression nut together to move the two friction bushings into contact with the second hinge knuckle.

2. The adjustable friction hinge of claim 1, wherein the openings in the first hinge knuckles are non-cylindrical and the two friction bushings have a complementary non-round cross-section and are slidably and non-rotatably retained in the non-cylindrical openings in the first hinge knuckles.

3. The adjustable friction hinge of claim 1, wherein the two friction bushings are slidably and non-rotatably retained in the openings in the first hinge knuckles.

4. The adjustable friction hinge of claim 1, wherein a barrel bushing with a non-round cross-section fits into the opening in the second hinge portion, which opening has a complementary non-round cross section, wherein the barrel bushing is formed of a material different than the second hinge portion, and wherein the friction bushings are formed of a material different than the barrel bushing.

5. The adjustable friction hinge of claim 1, wherein a barrel bushing, the threaded compression nut, and a non-threaded compression nut are formed of stainless steel, and the first hinge portion and second hinge portion are formed of a first plastic, and the friction bushings are formed of a second plastic.

6. The adjustable friction hinge of claim 1, wherein the friction bushings have inwardly facing beveled ends, and further comprising a barrel bushing non-rotatably positioned in the second hinge knuckle opening, the barrel bushing having a hole formed axially therethrough which is sized for the screw to pass therethrough and having bevels formed at each end, wherein the bevels of the friction bushings will impinge on the beveled ends of the barrel bushing.

7. An adjustable friction hinge, comprising:

a first hinge portion having two spaced apart first hinge knuckles with an opening formed in each first hinge knuckle;

a second hinge portion having a second hinge knuckle with an opening formed there, the second hinge knuckle rotatably fitting in a space between the two spaced apart first hinge knuckles;

a barrel bushing non-rotatably positioned in the second hinge knuckle opening, the barrel bushing having two beveled ends;

two friction bushings with beveled ends, one each slidably and non-rotatably located in the openings in the first hinge knuckles and being movable to engage with beveled ends of the barrel bushing;

a screw which passes through the two spaced apart first hinge knuckles and through the second hinge knuckle to cause the two frictional bushing to move into frictional contact with the second hinge knuckle to adjust a force required to move the first hinge portion and the second hinge portion relative to each other;

a threaded compression nut inserted in an outside of the opening in one of the two spaced apart first hinge knuckles, and a non-threaded compression nut inserted in an outside of the opening in the other of the two spaced apart first hinge knuckles, wherein the threaded compression nut and the non-threaded compression nut will, upon the screw being tightened, move the threaded compression nut and the non-threaded compression nut together to move the two friction bushings into contact with the barrel bushing.

8. The adjustable friction hinge of claim 7, wherein the barrel bushing is formed of a material different than the second hinge portion, and wherein the friction bushings are formed of a material different than the barrel bushing.

9. An adjustable friction hinge, comprising:

a first hinge portion having two spaced apart first hinge knuckles with opening formed in each first hinge knuckle;

a second hinge portion having a second hinge knuckle with an opening formed there, the second hinge knuckle rotatably fitting in a space between the two spaced apart first hinge knuckles;

a barrel bushing non-rotatably positioned in the second hinge knuckle opening and having an opening formed therein;

two friction bushings, one each slidably and non-rotatably located in the openings in the first hinge knuckles and being movable from first position wherein they do not project into the space between the two spaced apart first hinge knuckles to other positions wherein portions of the two friction bushings project into contact with the second hinge knuckle;

a threaded compression nut located in the opening in one of the two spaced apart first hinge knuckles;

a non-threaded compression nut located in the opening in the other of the two spaced apart first hinge knuckles;

a screw which passes through an anti-rotation lock washer and the non-threaded compression nut, the two spaced apart first hinge knuckles, the second hinge knuckle, the two friction bushings, and into the threaded compression nut, and wherein upon the screw being tightened, the threaded compression nut and the non-threaded compression nut will move closer together to cause the two frictional bushing to move into frictional contact with the barrel bushing to increase a force required to move the first hinge portion and the second hinge portion relative to each other.

10. The adjustable friction hinge of claim 9, wherein the friction bushings have inwardly facing beveled ends, and wherein the barrel bushing has bevels formed at each end, wherein the bevels of the friction bushings will impinge on the beveled ends of the barrel bushing.

* * * * *